US005971892A

United States Patent [19]

Lee

[11] Patent Number: 5,971,892

[45] Date of Patent: Oct. 26, 1999

[54] EXERCISER WITH COMBINED WALKING AND STEPPING FUNCTIONS

[76] Inventor: Sunny Lee, No. 257-8, Chung-Cheng Rd., TsaoTun Chen, Nan-Tou Hsien, Taiwan

[21] Appl. No.: 09/265,655

[22] Filed: Mar. 10, 1999

[51] Int. Cl.[6] ..... A63B 22/00

[52] U.S. Cl. ..... 482/52; 482/51; D21/192

[58] Field of Search ..... 482/51, 52, 53, 482/57, 79, 80, 114, 70, 62; 434/255

[56] References Cited

U.S. PATENT DOCUMENTS

| | | | |
|---|---|---|---|
| 4,861,023 | 8/1989 | Wu | 482/51 |
| 5,336,141 | 8/1994 | Vittone | 482/51 |
| 5,603,675 | 2/1997 | Wu | 482/51 |
| 5,733,226 | 3/1998 | Chen | 482/52 |
| 5,769,760 | 6/1998 | Lin et al. | 482/57 |
| 5,792,027 | 8/1998 | Gvoich | 482/52 |

*Primary Examiner*—Stephen R. Crow
*Attorney, Agent, or Firm*—Fish & Richardson P.C.

[57] ABSTRACT

An exerciser with combined walking and stepping functions includes a base frame with an upright portion. A movable support is fulcrumed at the upright portion and has two ends alternately turnable upward and downward. Two pairs of front swing rods are connected pivotally to the ends of the movable support. The rear swing rods are connected pivotally to the upright portion. A pair of pedal rods are connected pivotally to the bottom ends of the front and rear swing rods. A first locking device is mounted on the upright portion to lock the movable support against movement relative to the upright portion so as to place the pedal rods in a walking exercise configuration in which the pedal rods are movable forward and rearward. The first locking device releases the movable support when the pedal rods are in a stepping exercise configuration in which the pedal rods are turnable upward and downward relative to the bottom ends of the rear swing rods. A second locking device is mounted on the base frame to lock the bottom ends of the rear swing rods against movement relative to the base frame so as to place the pedal rods in the stepping exercise configuration. The second locking device releases the rear swing rods when the pedal rods are in the walking exercise configuration.

8 Claims, 8 Drawing Sheets

EXERCISER WITH COMBINED WALKING AND STEPPING FUNCTIONS

BACKGROUND OF THE INVENTION

1. Field of the Invention

This invention relates to an exerciser, more particularly to an exerciser with combined walking and stepping functions.

2. Description of the Related Art

Referring to FIG. 1, a conventional exerciser 10 with a stepping function is shown to comprise a base frame 11 having a front support leg 12 and a rear support leg 13 disposed at front and rear ends thereof, respectively. A generally rectangular handle portion 14 is mounted above the front support rod 12 to permit grasping by the user's hands. Two pedal members 15 are connected pivotally to a lower portion of the front support leg 12. Each of the pedal members 15 has a resistance cylinder 16 interconnecting the intermediate portion thereof and the intermediate portion of the front support leg 12. Therefore, the user can pedal the pedal members 15 up and down in order to perform the stepping function.

Referring to FIG. 2, a conventional exerciser 20 with a walking function is shown to comprise a base frame 21 having a handle portion 22 provided at a front end of the top portion of the base frame 21. The rear end of the top portion of the base frame 21 has two swing arms 23 pivotally connected thereto. Each of the swing arms 23 has a pedal plate 24 connected to a lower end thereof. In this way, the pedal plates 24 can be swung forward and backward when the user stands on the pedal plates 24 in order to perform the walking function.

It is noted that the aforesaid exercisers are not provided with both walking and stepping functions.

SUMMARY OF THE INVENTION

The object of the present invention is to provide an exerciser with combined walking and stepping functions.

According to the present invention, the exerciser with combined walking and stepping functions comprises:

a base frame with an upright portion;

a movable support fulcrumed at the upright portion and having two ends alternately turnable upward and downward about a horizontal axis;

a pair of front swing rods having bottom ends, and top ends which are connected pivotally to and hung on the ends of the movable support;

a pair of rear swing rods having bottom ends, and top ends which are connected pivotally to and hung on the upright portion;

a pair of pedal rods connected pivotally to the bottom ends of the front and rear swing rods, the pedal rods having footrest portions disposed rearward of the bottom ends of the rear swing rods;

first locking means mounted on the upright portion to lock the movable support against movement relative to the upright portion so as to place the pedal rods in a walking exercise configuration in which the pedal rods are movable forward and rearward, the first locking means releasing the movable support when the pedal rods are in a stepping exercise configuration in which the pedal rods are turnable upward and downward relative to the bottom ends of the rear swing rods; and second locking means mounted on the base frame to lock the bottom ends of the rear swing rods against movement relative to the base frame so as to place the pedal rods in the stepping exercise configuration, the second locking means releasing the rear swing rods when the pedal rods are in the walking exercise configuration.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
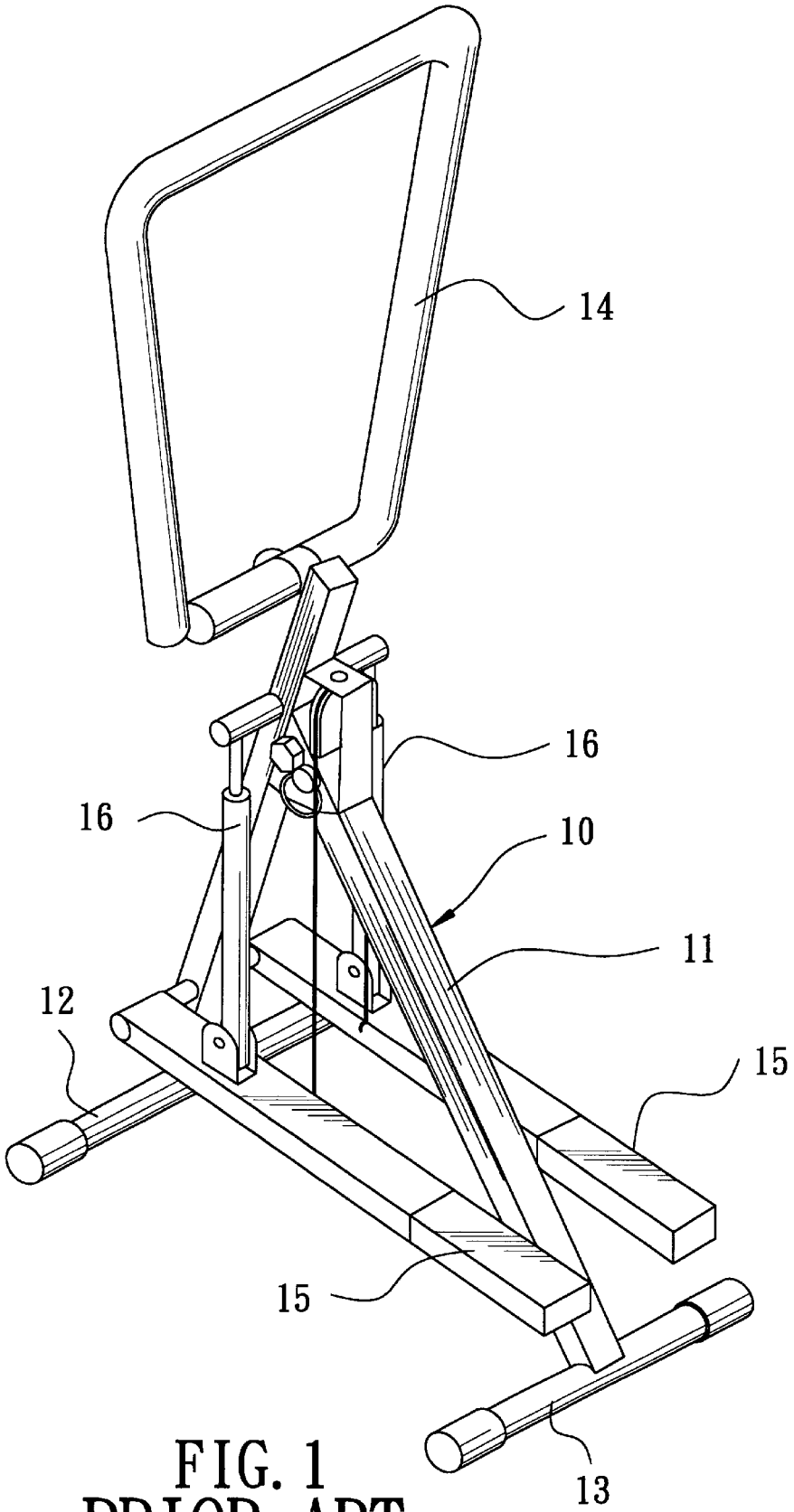
FIG. 1 PRIOR ART
FIG. 1 is a perspective view of a conventional exerciser with a stepping function.
Figure 2:
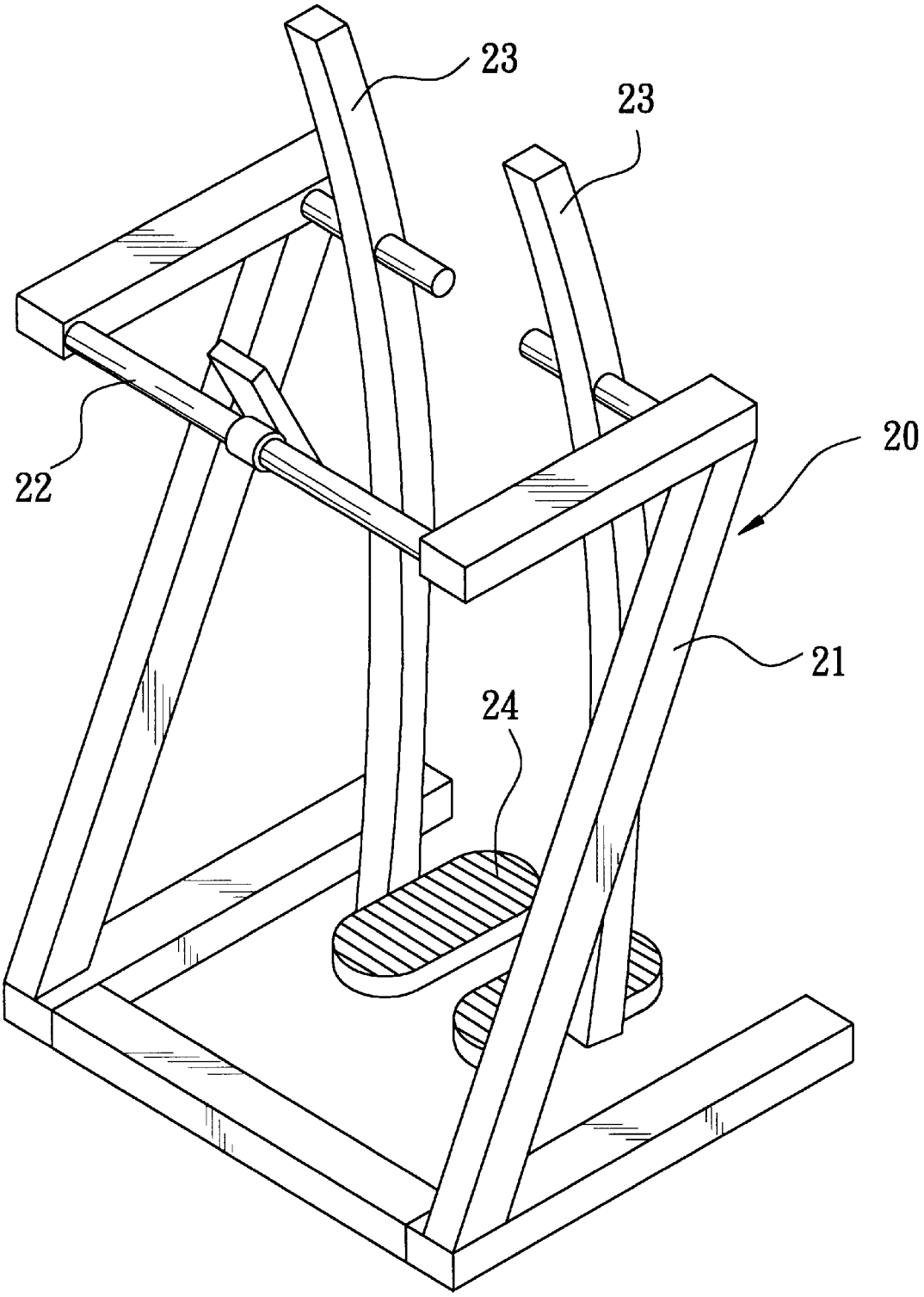
FIG. 2 PRIOR ART
FIG. 2 is a perspective view of another conventional exerciser with a walking function.
Figure 3:
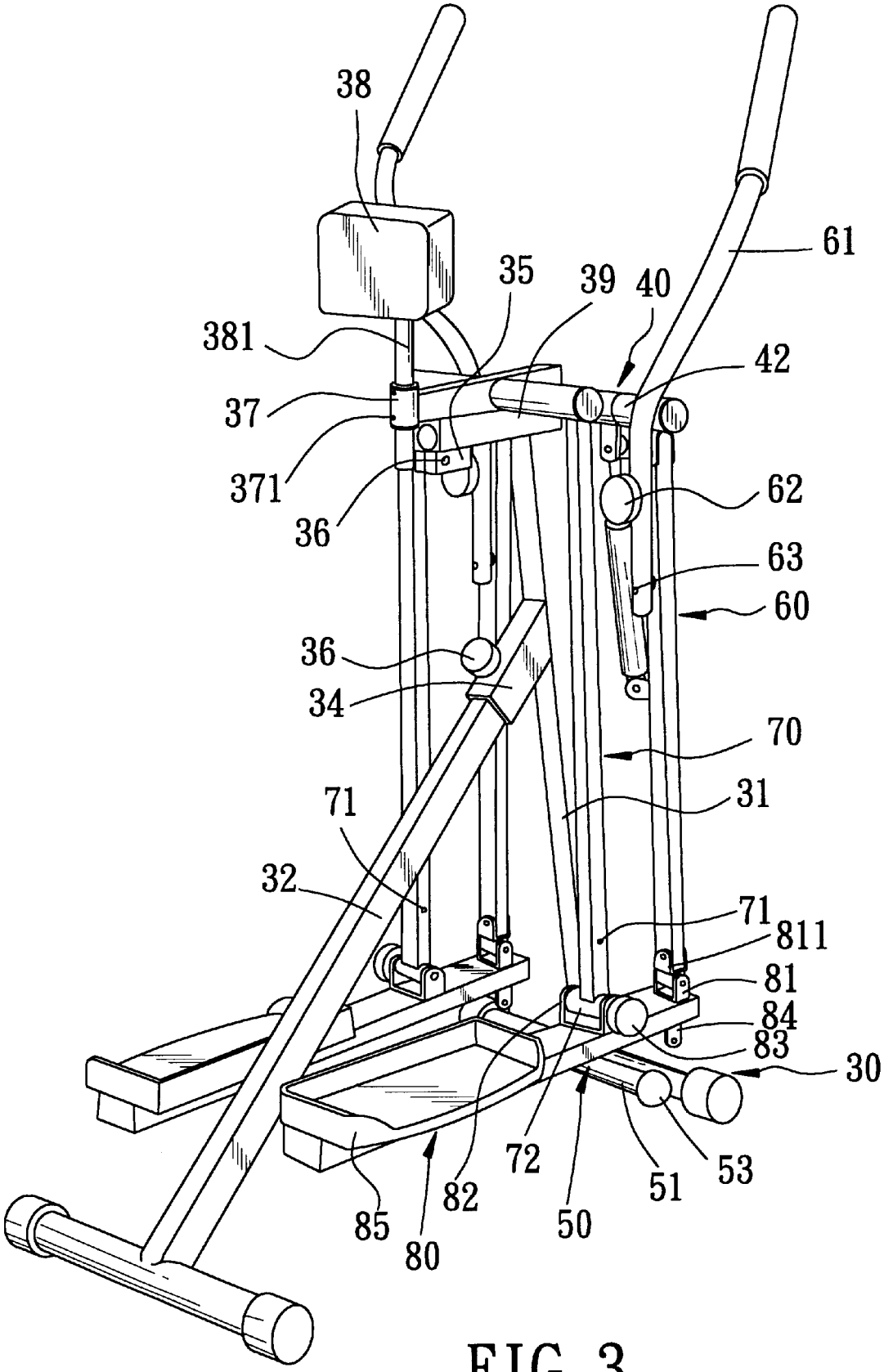
FIG. 3 is a perspective view of a preferred embodiment of an exerciser with combined walking and stepping functions according to the present invention.
Figure 4:
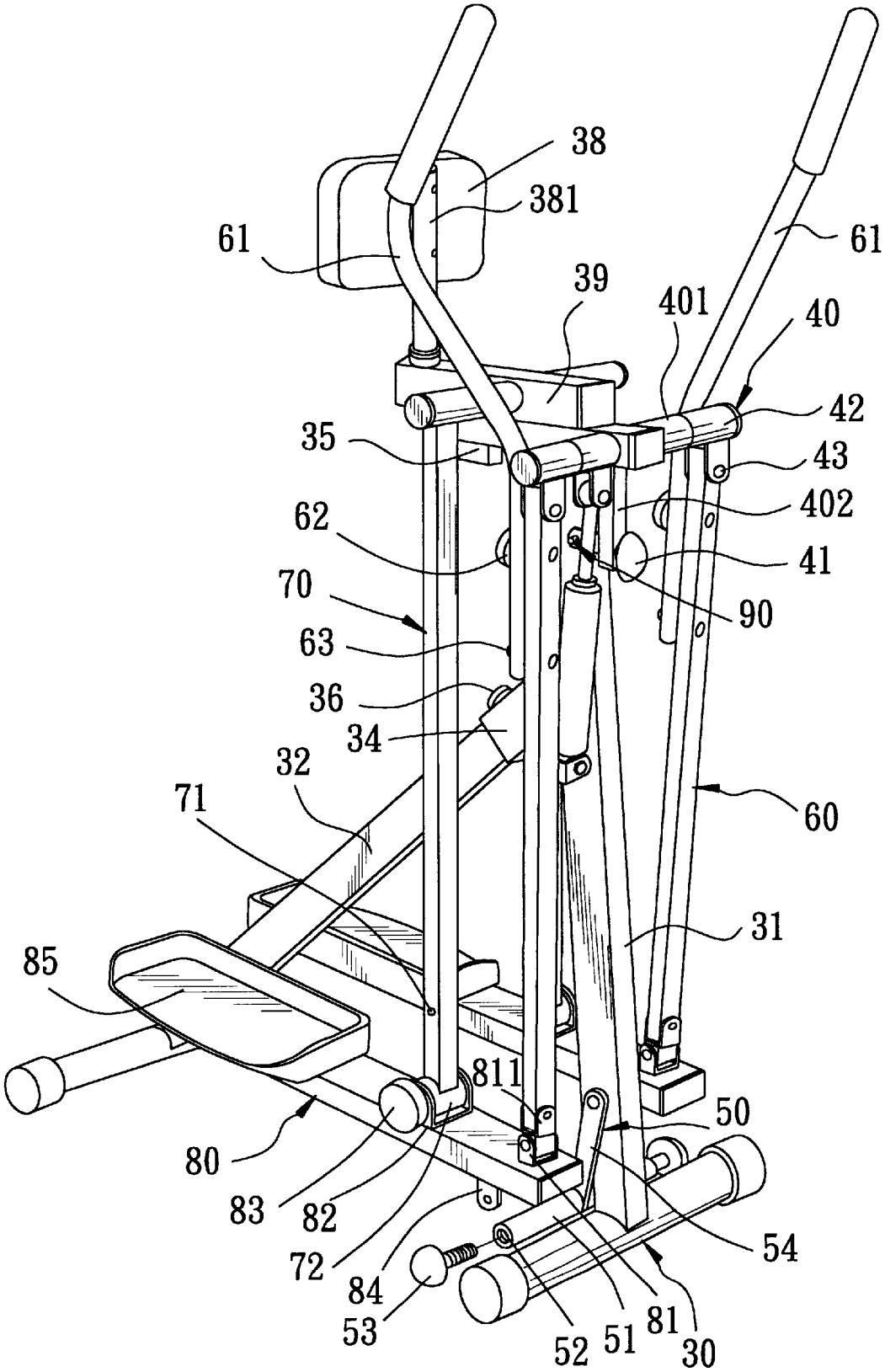
FIG. 4 is another perspective view of the preferred embodiment of the present invention.

Referring to FIGS. 3 and 4, a preferred embodiment of an exerciser with combined walking and stepping functions according to the present invention is shown to comprise a base frame 30, a movable support 40, a T-shaped locking member 50, a pair of front swing rods 60, a pair of rear swing rods 70 and a pair of pedal rods 80.

The base frame 30 has an upright portion that is formed of a front support rod 31 and a rear support rod 32 provided respectively at front and rear portions thereof. An upper cantilevered member 39 extending rearward from a top end of the front support rod 31. The rear side of the front support rod 31 has a first rectangular connecting sleeve 34 extending downwardly and rearward therefrom. An elongated slot 33 (see FIG. 5) is formed longitudinally in an intermediate section of the front support rod 31. The upper cantilevered member 39 has a second rectangular connecting sleeve 35 fixed to the underside thereof. The top end of the rear support rod 32 is adapted to be selectively received in one of the first and second rectangular connecting sleeves 34, 35 and be fastened to the same by means of a locking bolt 36. The rear end of the upper cantilevered member 39 has a vertical tube 37 fixed thereto and a cushion member 38 fixed to the vertical tube 37. More specifically, the cushion member 38 has an elongated stand 381 inserted through and fixed to the vertical tube 37 by screws 371.

The movable support 40 is a T-shaped member with first and second bars 401, 402. The first bar 401 is connected pivotally adjacent to the top end of the front support rod 31 at a central portion thereof so as to be alternately turnable upward and downward about a horizontal axis that extends in the front-to-rear direction. The ends of the first bar 401 have end sleeves 42 journalled thereon. The second bar 402 extends downwardly from the central portion of the first bar 401. The lower end of the second bar 402 is lockable to the front support rod 31 by means of a fastening bolt 41, as will be described hereinafter.

Figure 8:
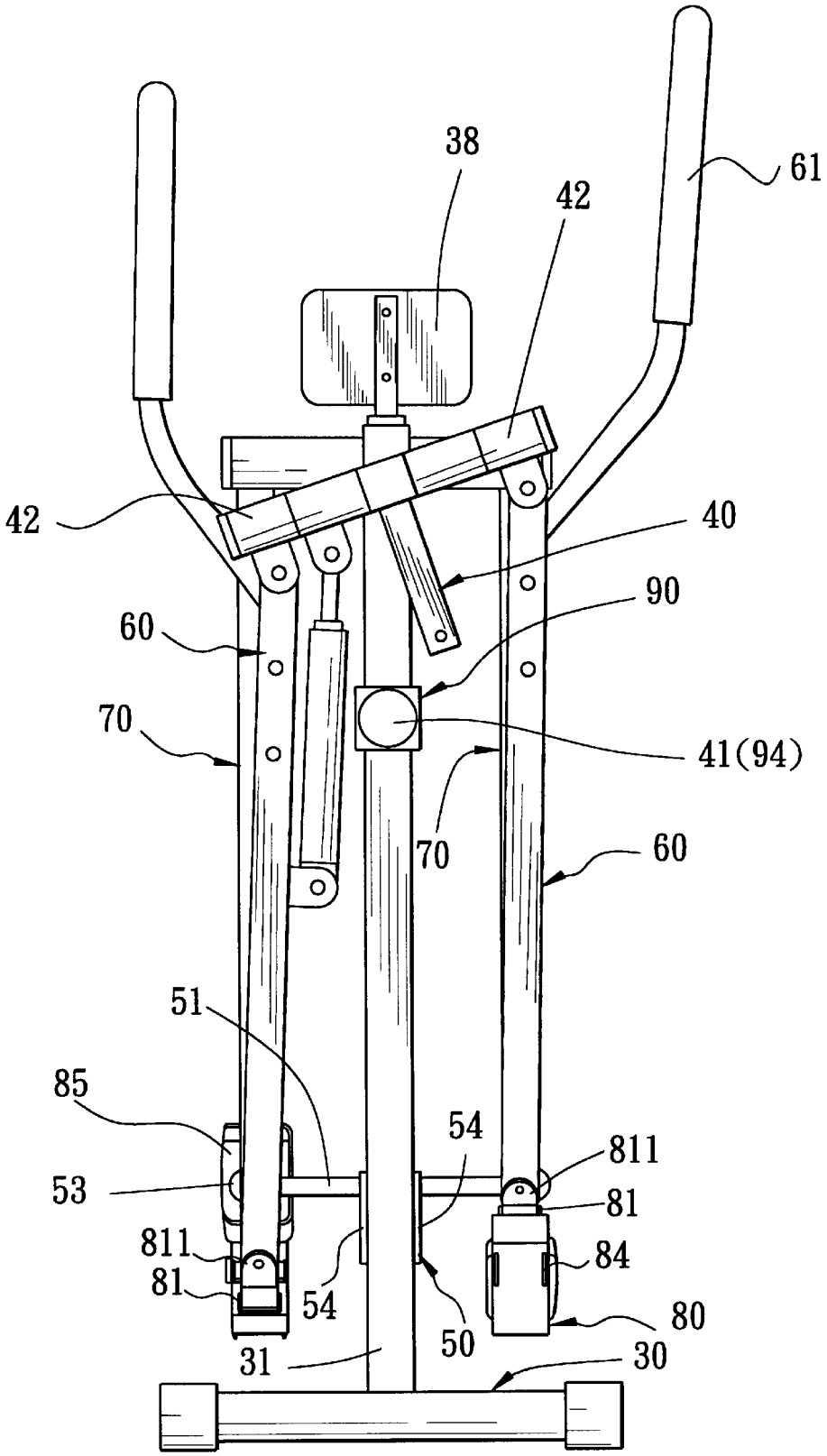
FIG. 8 is a front schematic view illustrating the preferred embodiment of the exerciser of the present invention in a waist-bending exerciser mode.

The T-shaped locking member 50 has a pair of first connecting rods 54 and a second connecting rod 51 (see FIG. 8). The first connecting rods 54 have first ends connected pivotally to two opposite sides of the front support rod 31 near the bottom end of the same, and second ends fixed to the central portion of the second connecting rod 51. The ends of the second connecting bar 51 have axial threaded holes 52 formed therein and two screw members 53 that engage the axial threaded holes 52.

Figure 9:
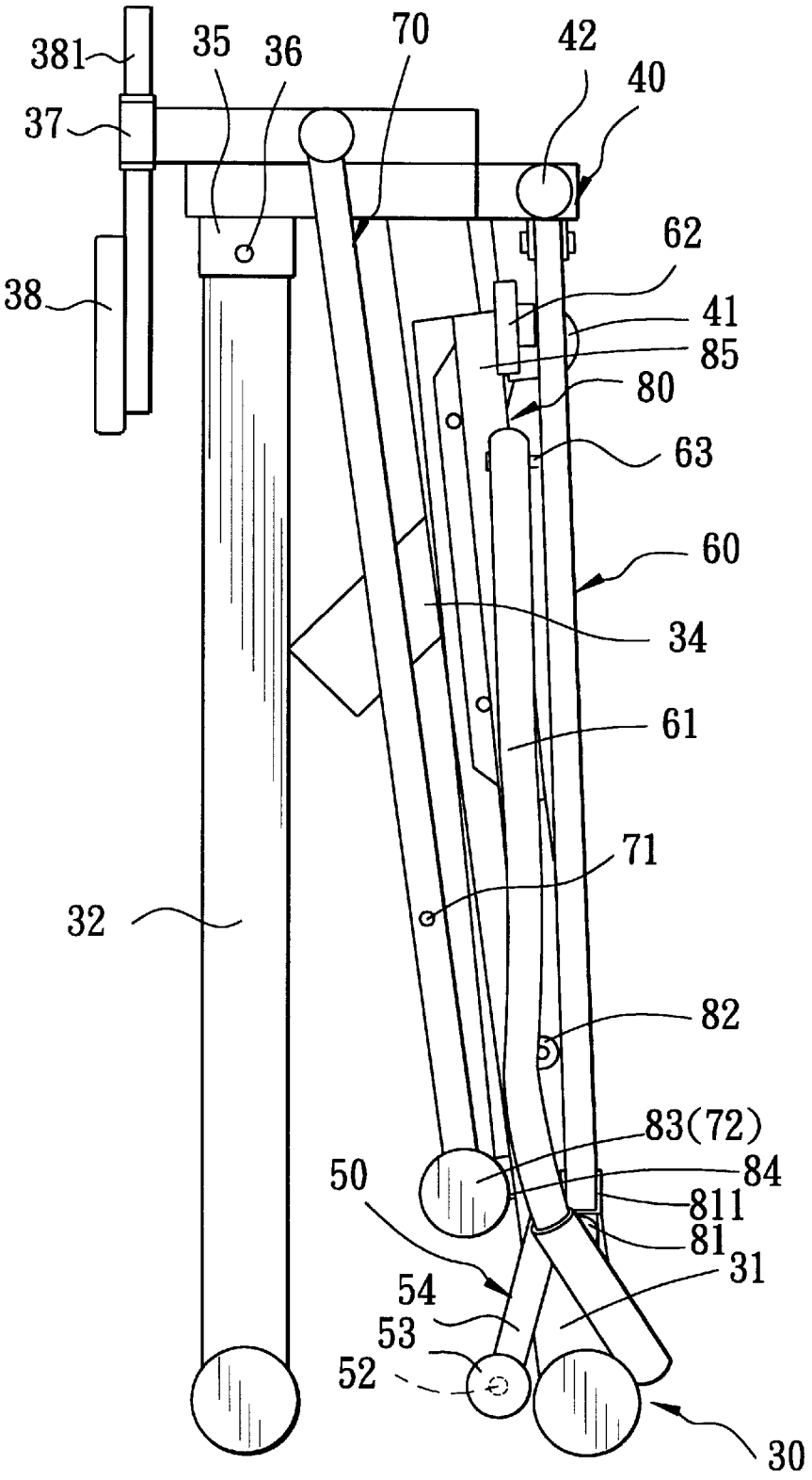
FIG. 9 is a side view of the preferred embodiment of the exerciser in a folded position.

The top ends of the front swing rods 60 are connected pivotally to the end sleeves 42 of the movable support 40 for turning leftward and rightward about pivot points 43. As such, the front swing rods 60 can swing relative to the base frame 30 in a front-to-rear direction about the longitudinal axis of the first bar 401 and a left-to-right direction about the pivot points 43. Each of the front swing rods 60 has a handle 61 connected adjacent to a respective one of the top ends thereof by means of first and second screw members 62, 63. The first screw members 62 may be unthreaded from the front swing rods 60 to pivot the handles 61 toward about the second screw members 63 to fold on the lower portions of the front swing rods 60, as best illustrated in FIG. 9.

The top ends of the rear swing rods 70 are connected pivotally to two sides of the upper cantilevered member 39. Each of the rear swing rods 70 has a through hole 71 formed adjacent to the bottom ends 72 thereof.

The pedal rods 80 are connected pivotally to the bottom ends of the front and rear swing rods 60, 70. Each of the pedal rods 80 has two first pivot seats 81, 811 that are connected pivotally a front end portion thereof to a respective one of the bottom ends of the front swing rods 60 in such a manner that the bottom ends of the front swing rods 60 can swing relative to the base frame 30 in a front-to-rear direction about the first pivot seats 81 and a left-to-right direction about the first pivot seats 811. Each of the pedal rods 80 further has a second pivot seat 82 that is fixed on the intermediate portion thereof and that is connected pivotally and detachably to a respective one of the bottom ends 72 of the rear swing rods 70 by a pivot pin 83, a footrest portion 85 disposed rearward of a corresponding one of the bottom ends 72 of the rear swing rods 70, and an engaging tab 84 formed on the underside adjacent to the front end portion thereof. The pivot pins 83 may be disengaged from the second pivot seats 82 and the bottom ends 72 of the rear swing rods 70 to permit upward and forward pivotal movement of the pedal rods 80, as best illustrated in FIG. 9. At this time, the pivot pins 83 can be inserted through the bottom ends 72 of the rear swing rods 70 and the engaging tabs 84 in order to fasten the same together.

Figure 5:
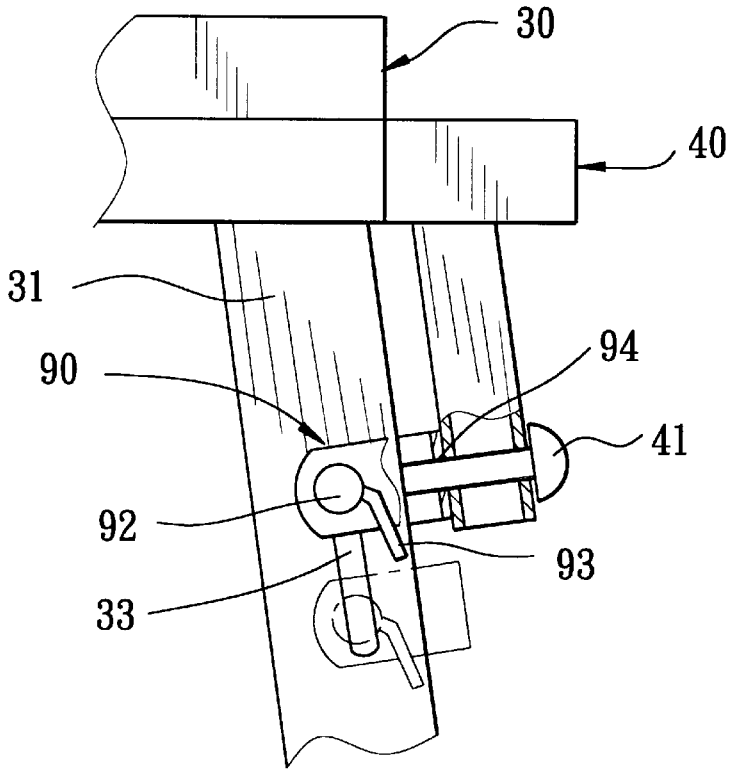
FIG. 5 is an enlarged, partly sectional, fragmentary side view of the preferred embodiment.

Referring to FIG. 5, a slide block 90 with a threaded hole 94 is mounted slidably in the elongated slot 33. A quick-release locking member 92 passes through the slide block 90 and the slot 33. The quick-release locking member 92 has a handle portion 93 that is operable to rotate the quick-release locking member 92 in order to position the slide block 90 relative to the front support rod 31. When the slide block 90 is moved to the upper end of the slot 33, the fastening bolt 41 can pass through the distal end of the second bar 402 of the movable support 40 and engage the threaded hole 94 in the slide block 90. As such, the movable support 40 can be locked against movement relative to the front support rod 31 so as to place the pedal rods 80 in a walking exercise configuration in which the pedal rods 80 are movable forward and rearward. On the other hand, when the fastening bolt 41 is disengaged from the slide block 90 to release the movable support 40, the pedal rods 80 are placed in a stepping exercise configuration in which the pedal rods 80 are turnable upward and downward relative to the bottom ends 72 of the rear swing rods 70. At this time, since the slide block 90 is released to move to the lower end of the slot 33 by means of rotating the quick-release locking member 92, the slide block 90 will not interfere with the distal end of the second bar 402 when the movable support 40 is turned. The ends of the second connecting rod 51 of the T-shaped locking member 50 are connected to the through holes 71 in the rear swing rods 70 to lock the rear swing rods 70 against movement relative to the base frame 30 so as to place the pedal rods 80 in the stepping exercise configuration. The T-shaped locking member 50 releases the rear swing rods 70 when the pedal rods 80 are in the walking exercise configuration.

Figure 6:
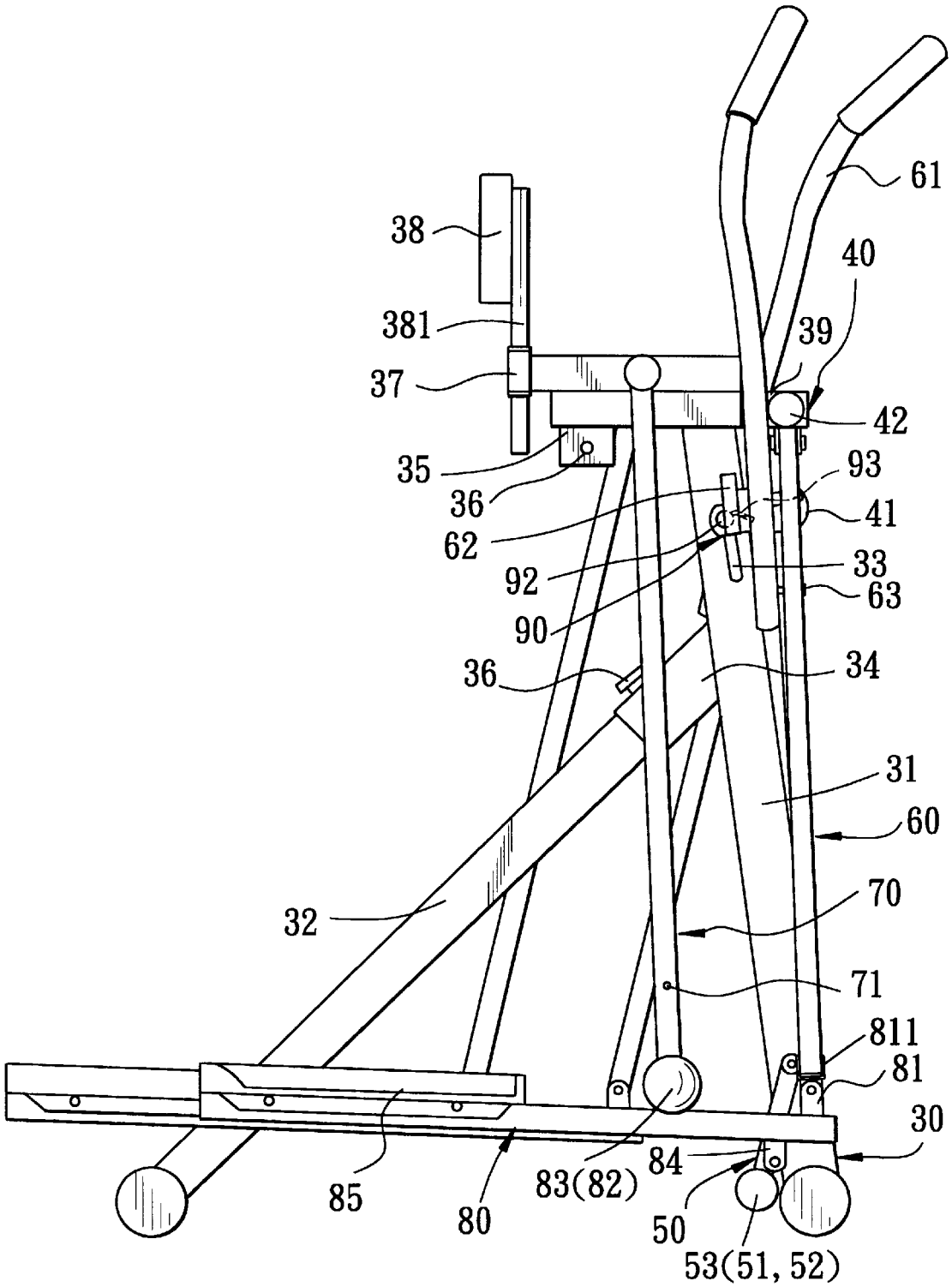
FIG. 6 is a side schematic view illustrating the preferred embodiment of the exerciser of the present invention in a walking exercise mode.

Referring to FIGS. 4 and 6, when the user wants to exercise in a walking exercise mode, the slide block 90 is moved to and locked in the upper end of the slot 33. The movable support 40 is then secured to the slide block 90 by the fastening bolt 41. The user can grasp the handles 61 and stand on the footrest portions 85 on the pedal rods 80 in the walking configuration. In this way, the user can move his legs forward and backward alternately on the pedal rods 80.

Figure 7:
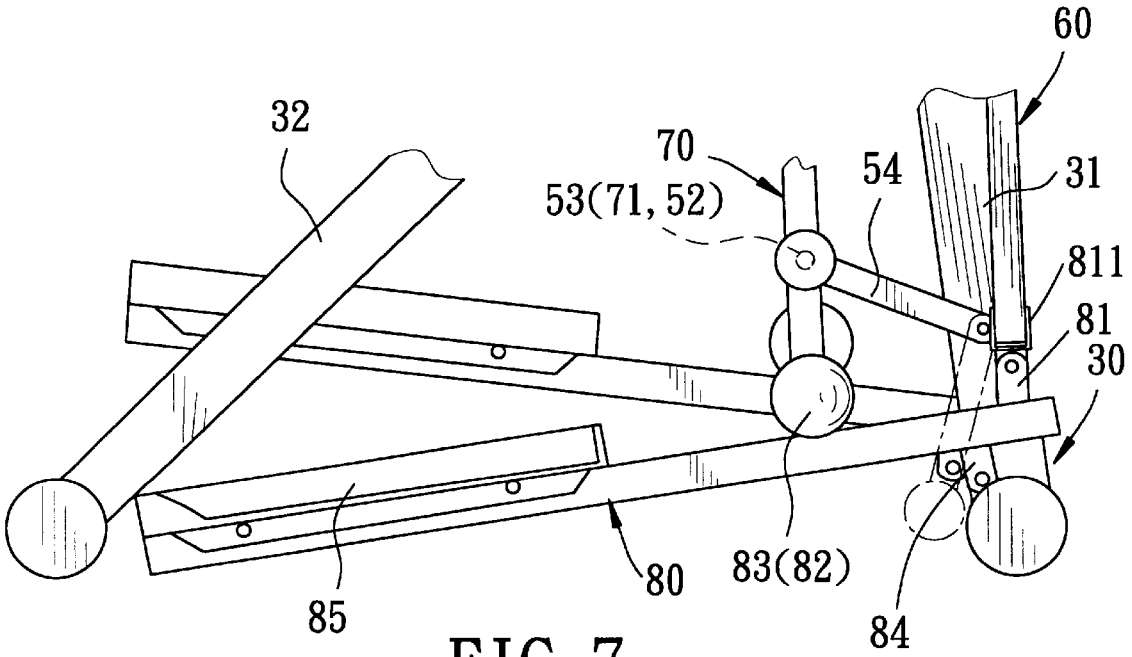
FIG. 7 is a fragmentary schematic view illustrating the preferred embodiment of the exerciser of the present invention in a stepping exercise mode.

Referring to FIG. 7, when the user wants to exercise in a stepping mode, the fastening bolt 41 is disengaged from the slide block 90 and the distal end of the second bar 402 to permit the movable support 40 to turn upwardly and downwardly. The slide block 90 is unlocked to move downward to the lower end of the slot 33 to prevent interference with the movable support 40. The fastening bolt 41 that is removed from the movable support 40 engages threadedly the threaded hole 94 in the slide block 90. Next, the screw members 53 are unthreaded from the axial threaded holes 52 of the T-shaped locking member 50. The T-shaped locking member 50 is turned upward to a position where the screw members 53 can thread through the through holes 71 in the rear swing rods 70 and engage the axial threaded holes 52 in the ends of the second connecting bar 51. As such, the rear swing rods 70 are fixed to the T-shaped locking member 50. Therefore, the pedal rods 80 can be pedaled up and down alternately by the user about the second pivot seats 82 on the pedal rods 80 in order to perform stepping exercise.

Referring to FIG. 8, when the pedal rods 80 are pedaled in the stepping exercise mode, since the handles 61 on the front swing rods 60 will move upwardly and downwardly together with the front swing rods 60, the user's arm can move with the handles and his waist can bend leftward and rightward to exercise his upper body part.

Referring to FIG. 9, the pivot pins 83 are disengaged from the rear swing rods 70 and the pedal rods 80 to detach the rear swing rods 70 from the pedal rods 80. The pedal rods 80 are turned upwardly about the first pivot seats 81 and then the rear swing rods 70 abut and engage the engaging tabs 84 by means of the pivot pins 83. Thereafter, the rear support rod 32 is detached from the first rectangular connecting sleeve 34 by removing the locking bolt 36 from the latter and is subsequently fastened to the second rectangular connecting sleeve 35 with the use of the locking bolt 36. Therefore, the rear support rod 32 can be converted from an inclined configuration to an upright configuration. The handles 61 are turned downwardly about the second screw members 63 after the first screw members 62 are removed from the front swing rods 60 in order to fold the handles 61 inside the base frame 30. In addition, the stand 381 of the cushion member 38 can be detached from the vertical tube 37 by releasing the screws 371, turning the stand 381 upside down, and inserting and fastening the stand 381 to the vertical tube 37 via the screws 371. In this way, the total volume of the exerciser of the present invention can be dramatically reduced in order to facilitate storage and transport of the exerciser.

The advantages of the exerciser of the present invention are as follows:

1. The exerciser can be used to perform selectively walking and stepping functions as desired.

2. The user can exercise his upper body part during the stepping exercise process.

3. The exerciser can be folded into a compact configuration for storing and transporting purposes.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An exerciser with combined walking and stepping functions, comprising:

a base frame with an upright portion;

a movable support fulcrumed at said upright portion and having two ends alternately turnable upward and downward about a horizontal axis;

a pair of front swing rods having bottom ends, and top ends which are connected pivotally to and hung on said ends of said movable support;

a pair of rear swing rods having bottom ends, and top ends which are connected pivotally to and hung on said upright portion;

a pair of pedal rods connected pivotally to said bottom ends of said front and rear swing rods, said pedal rods having footrest portions disposed rearward of said bottom ends of said rear swing rods;

first locking means mounted on said upright portion to lock said movable support against movement relative to said upright portion so as to place said pedal rods in a walking exercise configuration in which said pedal rods are movable forward and rearward, said first locking means releasing said movable support when said pedal rods are in a stepping exercise configuration in which said pedal rods are turnable upward and downward relative to said bottom ends of said rear swing rods; and second Locking means mounted on said base frame to lock said bottom ends of said rear swing rods against movement relative to said base frame so as to place said pedal rods in said stepping exercise configuration, said second locking means releasing said rear swing rods when said pedal rods are in said walking exercise configuration.

2. The exerciser with combined walking and stepping functions as claimed in claim 1, wherein said upright portion of said base frame has a front support rod with top and bottom ends provided at a front portion of said base frame, and an upper cantilevered member extending rearward from said top end of said front support rod.

3. The exerciser with combined walking and stepping functions as claimed in claim 2, wherein said movable support includes a T-shaped swing member with first and second bars, said first bar having two end portions and a central portion that is connected pivotally adjacent to said top end of said front support rod, said second bar extending downwardly from said central portion of said first bar, said end portions of said first bar having end sleeves journalled thereon and connected pivotally to said top ends of said front swing rods.

4. The exerciser with combined walking and stepping functions as claimed in claim 3, wherein said front support rod has an elongated slot formed longitudinally therein, and a slide block with a threaded hole slidable in said elongated slot, said first locking means including a fastening bolt passing through a distal end of said second bar of said movable support and engaging said threaded hole in order to fix said movable support relative to said front support rod.

5. The exerciser with combined walking and stepping functions as claimed in claim 2, wherein said front support rod has a first connecting sleeve extending rearwardly and downwardly therefrom adjacent to said top end of said front support rod, said upper cantilevered member having a second connecting sleeve fixed to an under side thereof, said base frame further having a rear support rod connected selectively and releaseably to one of said first and second connecting sleeves.

6. The exerciser with combined walking and stepping functions as claimed in claim 1, wherein each of said bottom ends of said rear swing rods is connected releaseably to an intermediate portion of a respective one of said pedal rods, each of said pedal rods having an engaging tab that is connected detachably to the respective one of said bottom ends of said rear swing rods.

7. The exerciser with combined walking and stepping functions as claimed in claim 1, wherein each of said front swing rods has a handle connected adjacent to said top end thereof.

8. The exerciser with combined walking and stepping functions as claimed in claim 2, wherein said second locking means comprises a T-shaped locking member having a pair of first connecting rods and a second connecting rod, said first connecting rods having first ends connected pivotally adjacent to said bottom end of said front support rod, and second ends that are fixed to a central portion of said second connecting rod, said second connecting rod having two ends connected detachably adjacent to said bottom is ends of said rear swing rods.

* * * * *